US005732492A

United States Patent [19]

Lin

[11] Patent Number: 5,732,492

[45] Date of Patent: Mar. 31, 1998

[54] CRYSTAL WATER BALL DEVICE

[76] Inventor: Chung-Kuei Lin, 64-4, No. 1, Wuchuan 1st Rd., Wuku Industrial Dist., Hsinchuang City, Taipei Hsien, Taiwan

[21] Appl. No.: 715,400

[22] Filed: Sep. 18, 1996

[51] Int. Cl.[6] ..... G09F 19/00

[52] U.S. Cl. ..... 40/410; 446/267

[58] Field of Search ..... 40/409, 410; 446/267

[56] References Cited

U.S. PATENT DOCUMENTS 5,092,065 3/1992 Teng ..... 40/410

5,286,535 2/1994 Hou ..... 446/267 X 5,548,912 8/1996 Liu ..... 40/410 X 5,620,353 4/1997 Lai ..... 40/410 X

*Primary Examiner*—Kenneth J. Dorner

*Assistant Examiner*—Andrea Chop

*Attorney, Agent, or Firm*—Kerkam, Stowell, Kondracki & Clarke, P.C.; John C. Kerins

[57] ABSTRACT

A crystal water ball device comprising a combination of a globe and a housing supported, via a securely mounted support plate, over a base frame. A lower cup is rotatably supported on the base frame in a frictional manner and is prevented from an upward movement relative to the base frame. A transmission mechanism is provided for driving the lower cup to rotate.

6 Claims, 6 Drawing Sheets

CRYSTAL WATER BALL DEVICE

BACKGROUND OF THE INVENTION

1. Field of the Invention

The present invention relates to decorative articles and more particularly to a crystal water ball device which exhibits multi-functional entertainment.

2. Description of Related Art

Prior crystal water ball or similar articles are too simple in structure such that they can be termed as 'static,' which means they lack other auxiliary or added functions except for very simple ones like exhibition of decorations and making sound. It is thus desirable to have a crystal water ball which is versatile or 'dynamic' as to provide constantly rotational parts, electrically-controlled sound and lighting, in addition to static exhibitions.

A crystal water ball device fulfilling the above-mentioned dynamic requirement and exhibiting other features is disclosed in same Applicant's another patent application. The crystal water globe in said application is directed to solve the problem of water leaking out under the circumstance that a motor-driven rotating part is employed.

The present invention aims to provide a dynamic crystal water ball device of a different construction.

SUMMARY OF THE INVENTION

A primary object of the present invention is to provide a crystal water ball device which comprises a base frame, a lower cup rotatably supported on the base frame and a transmission for driving the lower cup to rotate on the base frame, wherein the lower cover slidably contacts the base frame at a small area of contact. A display drum is placed outside the lower cup to rotate therewith.

In accordance with a feature of the invention, the crystal water-ball device comprises a fork member which is also driven by the transmission.

In accordance with another feature of the present invention, the base frame of the crystal water ball device fixedly supports a support plate and a combination of a globe and a housing. The base frame has an annular step and a plurality of posts adjacent to the annular step, the lower cup has an annular ring supported on the annular step, and a plurality of set screws each corresponding to and engaging with one of the plurality of posts are provided to prevent the lower cup from an upward movement relative to the base frame.

Other objects and novel features of the invention will become more apparent from the following detailed description when taken in conjunction with the accompanying drawings.

DETAILED DESCRIPTION OF PREFERRED EMBODIMENT

Figure 1:
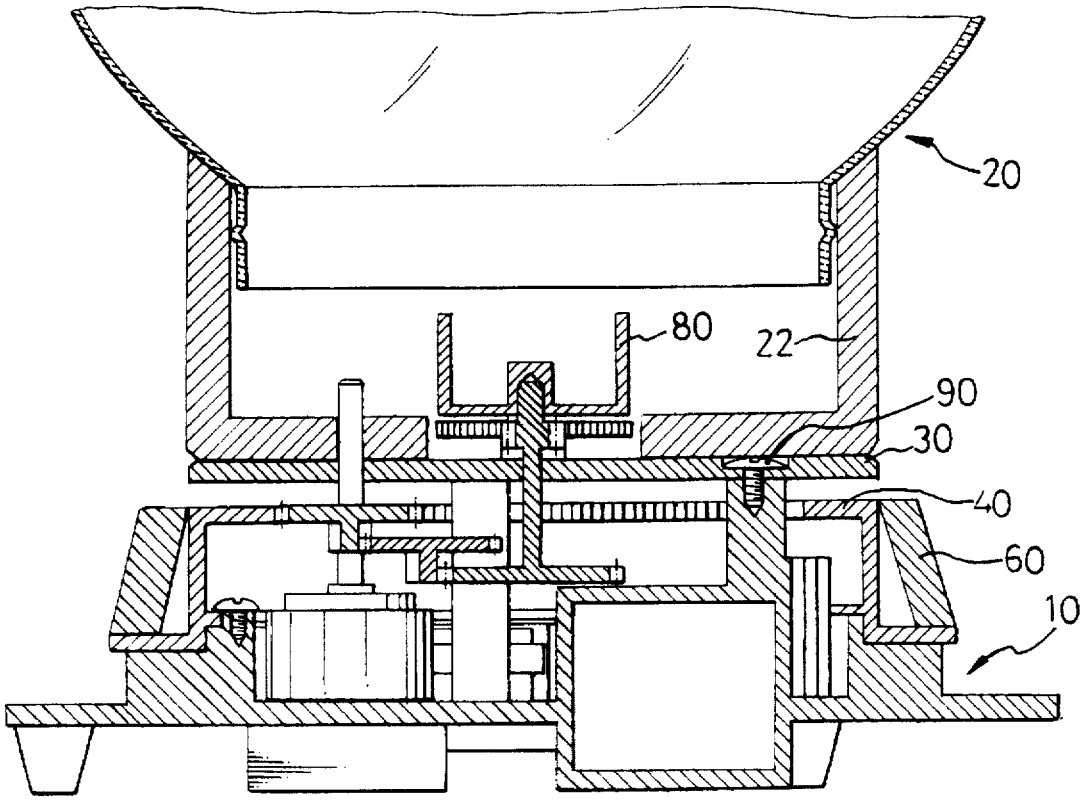
FIG. 1 is a cross-section showing a crystal water ball device in accordance with the present invention.
Figure 2:
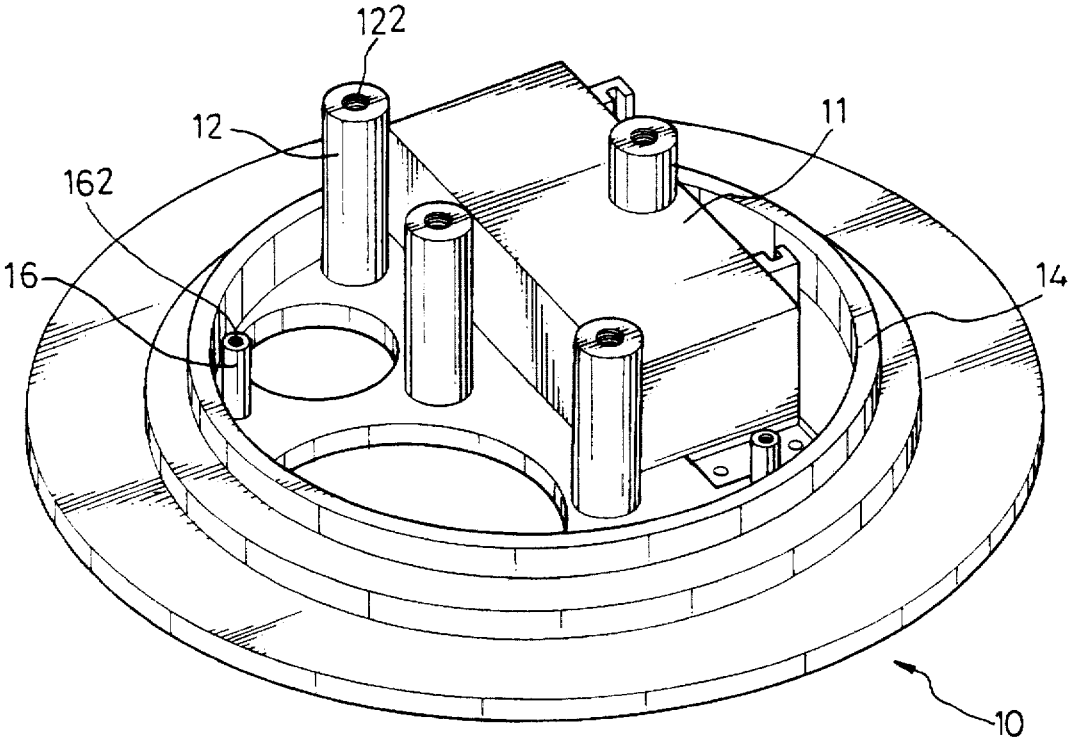
FIG. 2 shows a perspective view of a base frame of the crystal water ball device of FIG. 1.

FIG. 1 shows a crystal water ball device of the invention which comprises a base frame 10 and a globe and a housing combination 20 supported above the base frame 10 via a support plate 30. The base frame 10 further supports a lower cup 40. As is clearly shown in FIG. 2, the base frame 10 comprises a plurality of protrusions 12, an annular step 14 and a plurality of posts 16 adjacent to the annular step 14. In the embodiment shown, there are three identical protrusions 12 and a fourth protrusion 13 having a same upper construction but extending from a battery box 11. The protrusions 12 and 13 have a top face level with each other and each has a threaded hole 122 in a top portion thereof. The lateral width of the annular step 14 is made as small as possible and an inside wall surface of the annular step 14 is made very close to an outside surface of each post 16. Each post 16 also has a threaded hole 162 in a top portion thereof.

The positioning of the support plate 30 on the base frame 10 is achieved by providing a plurality of fasteners 90 each corresponding to and engaging with one of the protrusions 12. Each fastener 90 extends through the support plate 30 and threadingly engages into a respective one of the threaded holes 122 to such a degree that a top head of the fastener 90 is substantially below a top face of the support plate 30.

Figure 4:
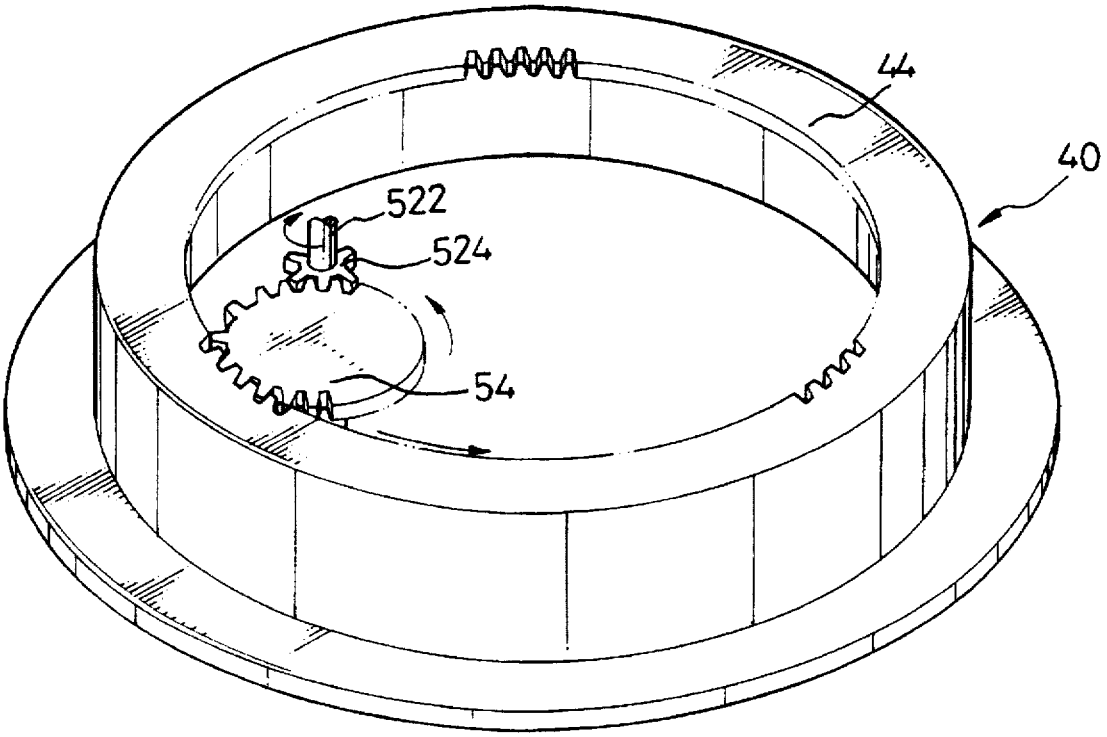
FIG. 4 shows a lower cup and a part of the transmission which engages and drives the lower cup.

A lower cup 40 is rotatably supported on the base frame 10 and has an annular ring 42. The annular ring 42 has an annular bearing surface 422 which slidably contacts the annular step 14 of the base frame 10 and a toothed portion 44 (cf. FIG. 4). As is clearly shown in FIG. 5, the lower cup 40 contacts the base frame 10 solely by way of the annular bearing surface 422 resting on the top face of the annular step 14. The other portions of the lower cup 40 are spaced from the base frame 10 a small distance, approximately 0.2 to 0.3 millimeters. This ensures a rotational movement of the lower cup 40 over the base frame 10 in a sliding contact. As can be understood, a display drum 60 (cf. FIG. 1) is disposed on and outside the lower cup 40.

Figure 3:
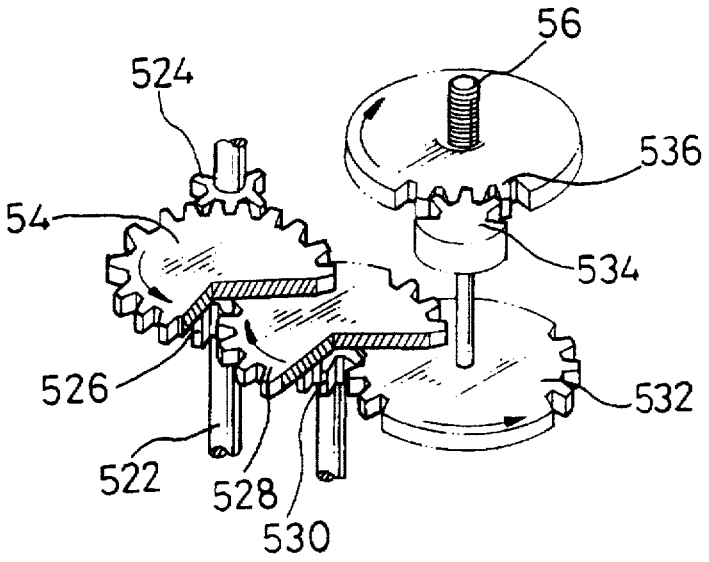
FIG. 3 shows a transmission mechanism of the crystal water ball device of FIG. 1.

FIG. 3 shows a transmission 50 utilized in the crystal water ball device of FIG. 1. The transmission 50 comprises a motor-driven gear train 52, an output gear 54 and a terminal screw 56 both driven by the gear train 52. A fork member 80 (cf. FIG. 1) is threadingly engaged and therefore rotatable with the terminal screw 56 for further driving purpose to be described later. The gear train 52, in this embodiment, comprises a motor shaft 522 having a pair of gears 524, 526 rotationally fixed thereto. One Of the gears, the gear 524 in the present embodiment, is in mesh with the output gear 54 which in turn engages with the toothed portion 44 and the other gear 526 drives, via gears 528, 530, 532, 534, a gear 536 which is rotationally secured with the terminal screw 56. The gear train 52 thus drive both the lower cup 40 and the terminal screw 56. Furthermore, the motor shaft 522 may extend through the support plate 30 and the housing 22 of the globe and housing combination 20 in order to properly position the combination 20 with respect to support plate 30.

Figure 5:
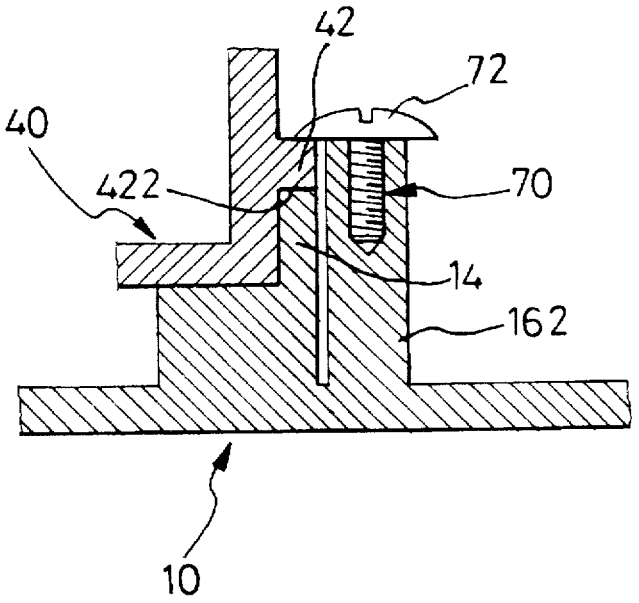
FIG. 5 shows a part of the base frame and a part of the lower cup which contact each other and wherein the lower cup is prevented from an upward movement relative to the base frame.

Referring to FIG. 5, in order to prevent the lower cup 40 from an upward movement relative to the base frame 10, a plurality of set screws 70 are each engaged with a corresponding post 162. Each screw 70 has a wide head 72 and is inserted into the post 162. The post 162 has such a height that the wide head 72 extends over the annular ring 42 to confine the annular ring 42 between a space defined by a part of the wide head 72 of the lower cup 40 and the annular step 14 of the base frame 10.

Figure 6:
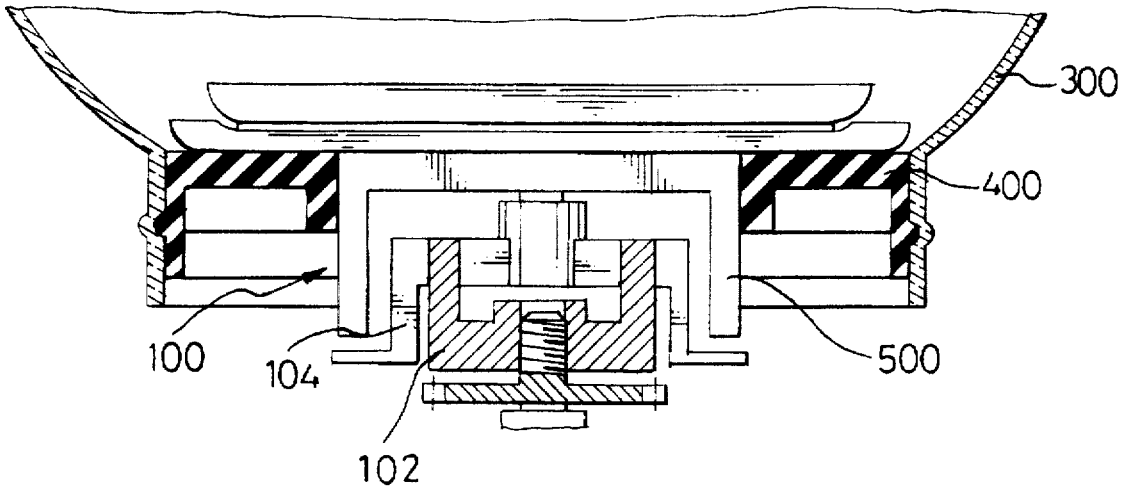
FIG. 6 exemplarily shows a terminal screw of the invention being adapted to a mechanism situated at a bottom of a globe.
Figure 7:
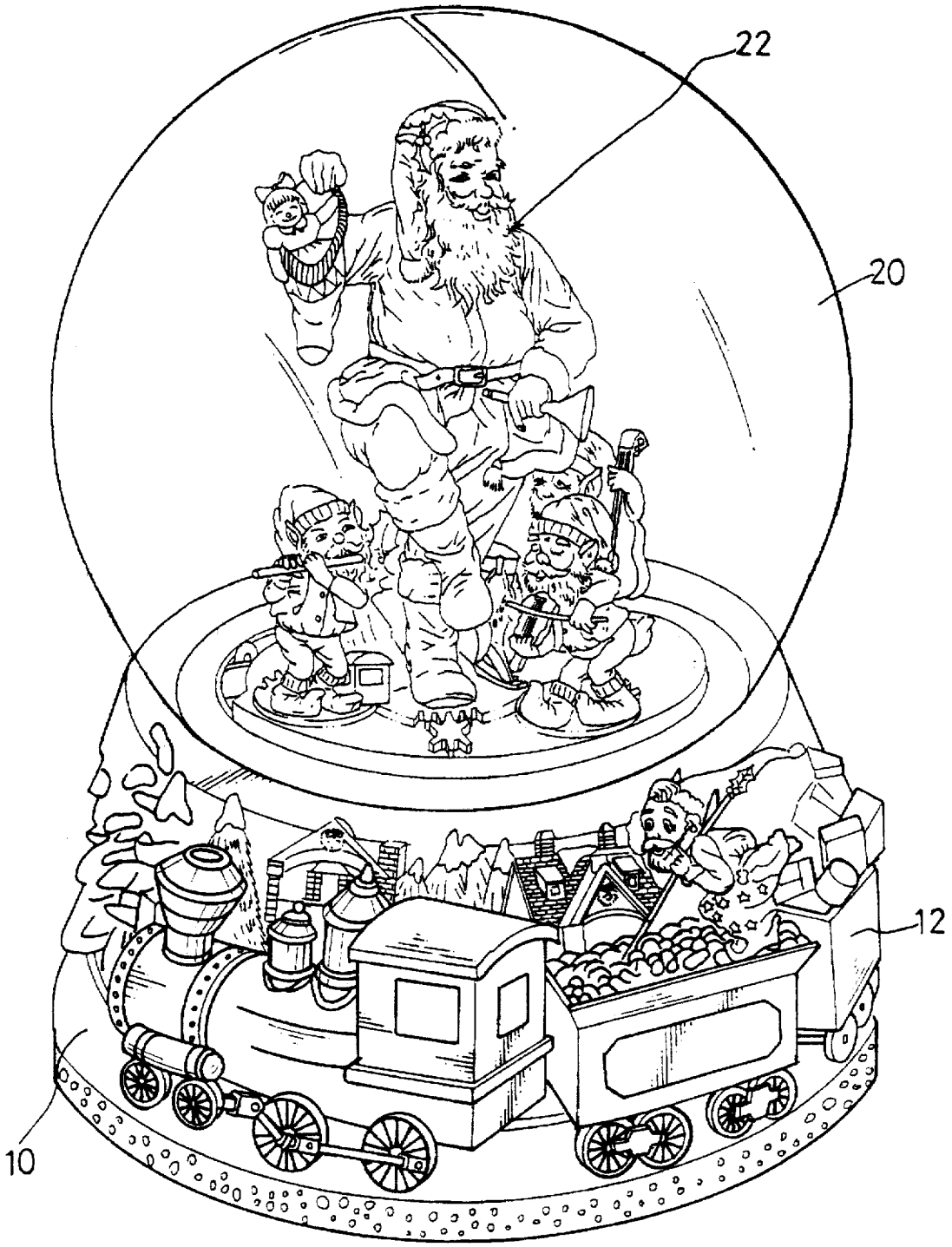
FIG. 7 exemplarily shows a crystal water ball device which embodies the present invention.

FIG. 6 shows an example of how the terminal screw 56 transmits its rotational movement, via an intermediate mechanism 100, to drive a gear train (shown by phantom line in FIG. 7). The intermediate mechanism 100 comprises a fork member 102 fixedly connected to the terminal screw 56 and a coupling member 104 engaged to and rotatable with the fork member 102 and is suitably supported with respect to the globe 300 by a plug 400 and a bracket 500. The coupling member 104 has a shaft extending upward to the bracket 500.

FIG. 7 exemplarily shows a crystal water ball device which embodies the present invention. As shown, suitable decorations 12 can be provide outside of the display drum 60 and a plurality of gears (shown by phantom line and not numbered) can be arranged to be driven by the fork member 80 (FIG. 1) or 102 (FIG. 6). The decorations 12 and the gears then will be rotated simultaneously.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A crystal water ball device comprising:

a combination of a globe and a housing;

a base frame having a plurality of protrusions;

a support plate interposed between the plurality of protrusions of the base frame and the combination of globe and housing, the support plate carrying the combination of globe and housing thereon;

a lower cup rotatably supported on the base frame and having an annular bearing surface formed thereon, the annular bearing surface slidably contacting the base frame;

a plurality of fasteners each corresponding to one of the protrusions, the fasteners extending through the support plate and threadingly engaging into a corresponding protrusion to such an extent that a top head of the fastener is substantially below a top face of the support plate;

means for preventing the lower cup from an upward movement relative to the base frame; and a transmission mechanism for driving the lower cup to rotate.

2. The device as claimed in claim 1, further comprising a fork member, and wherein the transmission mechanism comprises a terminal screw for threadedly engaging and rotating the fork member.

3. The device as claimed in claim 1, further comprising a display drum disposed on and outside the lower cup.

4. A crystal water ball device comprising:

a combination of a globe and a housing;

a base frame having a plurality of protrusions, an annular step and a plurality of posts adjacent to the annular step;

a support plate interposed between the plurality of protrusions of the base frame and the combination of globe and housing, the support plate carrying the combination of globe and housing thereon;

a lower cup having an annular ring rotatably supported on the annular step;

means for securely retaining the support plate to the plurality of protrusions;

a plurality of set screws each corresponding to and engaging with one of the plurality of posts, each screw having a wide head extending over the annular ring; and a transmission mechanism for driving the lower cup to rotate.

5. A crystal water ball device comprising:

a combination of a globe and a housing;

a base frame having a plurality of protrusions;

a support plate interposed between the plurality of protrusions of the base frame and the combination of globe and housing, the support plate carrying the combination of globe and housing thereon;

a lower cup rotatably supported on the base frame and having an annular bearing surface formed thereon and a toothed portion, the annular bearing surface slidably contacting the base frame;

means for securely retaining the support plate to the plurality of protrusions;

means for preventing the lower cup from an upward movement relative to the base frame;

a fork member; and a transmission mechanism for driving the lower cup to rotate, the transmission mechanism comprising:

a motor-driven gear train;

an output gear engaging with the toothed portion of the lower cup; and a terminal screw driven by the motor-driven gear train and threadedly engaging and rotating the fork member.

6. The device as claimed in claim 5, wherein the gear train comprises a motor shaft extending through the support plate and the housing for preventing the combination of globe and housing from a lateral movement relative to the support plate.

* * * * *